US007242374B2

(12) United States Patent
Jeong et al.

(10) Patent No.: US 7,242,374 B2
(45) Date of Patent: Jul. 10, 2007

(54) APPARATUS AND METHOD FOR DRIVING PLASMA DISPLAY PANEL USING ADAPTIVE WAVEFORM MECHANISM

(75) Inventors: Jae-Seok Jeong, Cheonan (KR); Seong-Charn Lee, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 393 days.

(21) Appl. No.: 10/459,534

(22) Filed: Jun. 12, 2003

(65) Prior Publication Data

US 2003/0231147 A1 Dec. 18, 2003

(30) Foreign Application Priority Data

Jun. 12, 2002 (KR) ..... 10-2002-0032908

(51) Int. Cl.
*G09G 3/28* (2006.01)

(52) U.S. Cl. ..... 345/60; 345/62; 313/582; 315/169.4

(58) Field of Classification Search ..... 345/60–63, 345/692, 66–68, 204; 315/169.3, 169.4; 313/582, 585
See application file for complete search history.

(56) References Cited

U.S. PATENT DOCUMENTS

| | | | | |
|---|---|---|---|---|
| 6,542,135 | B1 * | 4/2003 | Kasahara et al. | 345/63 |
| 6,924,778 | B2 * | 8/2005 | Awamoto et al. | 345/60 |
| 2001/0020923 | A1 * | 9/2001 | Homma | 345/60 |
| 2002/0008680 | A1 * | 1/2002 | Hashimoto et al. | 345/63 |
| 2002/0180665 | A1 * | 12/2002 | Awamoto et al. | 345/60 |

* cited by examiner

*Primary Examiner*—Richard Hjerpe
*Assistant Examiner*—Mansour M. Said
(74) *Attorney, Agent, or Firm*—H.C. Park & Associates, PLC

(57) ABSTRACT

In a PDP driving method, an image of each field displayed on the PDP corresponding to an input video signal is divided into sub-fields with different weights, and a combination of the weights is used for gradation. The method includes: determining an automatic power control (APC) level for driving the PDP; determining a pulse width comprising any one of an address pulse width, a sustain pulse width, and a reset pulse width, or a combination of at least two of the three pulse widths for each sub-field using the APC level, the determined pulse width including as an increment a part of a pause period occurring in driving the PDP at the APC level; and performing addressing on the PDP according to the pulse width.

19 Claims, 6 Drawing Sheets

*FIG.2*

| APC LEVEL | NUMBER OF SUSTAIN PULSES | RESIDUAL TIME (μs) | USED TIME (μs) | 1SF | 2SF | 3SF | 4SF | 5SF | 6SF | 7SF | 8SF | 9SF | 10SF | 11SF | 12SF |
|---|---|---|---|---|---|---|---|---|---|---|---|---|---|---|---|
| 1 | 2026 | 685.000 | 665.429 | 1.935 | 1.935 | 1.935 | 1.813 | 1.813 | 1.752 | 1.752 | 1.650 | 1.650 | 1.650 | | |
| 2 | 2014 | 715.000 | 694.571 | 1.948 | 1.948 | 1.948 | 1.820 | 1.820 | 1.756 | 1.756 | 1.650 | 1.650 | 1.650 | | |
| 3 | 1998 | 755.000 | 733.429 | 1.965 | 1.965 | 1.965 | 1.830 | 1.830 | 1.762 | 1.762 | 1.650 | 1.650 | 1.650 | | |
| 4 | 1984 | 790.000 | 767.429 | 1.979 | 1.979 | 1.979 | 1.838 | 1.838 | 1.768 | 1.768 | 1.650 | 1.650 | 1.650 | | |
| 5 | 1972 | 820.000 | 796.571 | 1.992 | 1.992 | 1.992 | 1.845 | 1.845 | 1.772 | 1.772 | 1.650 | 1.650 | 1.650 | | |
| 6 | 1958 | 855.000 | 830.571 | 2.006 | 2.006 | 2.006 | 1.854 | 1.854 | 1.777 | 1.777 | 1.650 | 1.650 | 1.650 | | |
| 7 | 1944 | 890.000 | 864.571 | 2.021 | 2.021 | 2.021 | 1.862 | 1.862 | 1.782 | 1.782 | 1.650 | 1.650 | 1.650 | | |
| 8 | 1932 | 920.000 | 893.714 | 2.033 | 2.033 | 2.033 | 1.869 | 1.869 | 1.787 | 1.787 | 1.650 | 1.650 | 1.650 | | |
| 9 | 1920 | 950.000 | 922.857 | 2.046 | 2.046 | 2.046 | 1.876 | 1.876 | 1.791 | 1.791 | 1.650 | 1.650 | 1.650 | | |
| 10 | 1904 | 990.000 | 961.714 | 2.063 | 2.063 | 2.063 | 1.886 | 1.886 | 1.797 | 1.797 | 1.650 | 1.650 | 1.650 | | |
| 11 | 1892 | 1,020.000 | 990.857 | 2.075 | 2.075 | 2.075 | 1.893 | 1.893 | 1.802 | 1.802 | 1.650 | 1.650 | 1.650 | | |
| 12 | 1876 | 1,060.000 | 1,029.714 | 2.092 | 2.092 | 2.092 | 1.902 | 1.902 | 1.808 | 1.808 | 1.650 | 1.650 | 1.650 | | |
| 13 | 1862 | 1,095.000 | 1,063.714 | 2.106 | 2.106 | 2.106 | 1.911 | 1.911 | 1.813 | 1.813 | 1.650 | 1.650 | 1.650 | | |
| 14 | 1852 | 1,120.000 | 1,088.000 | 2.117 | 2.117 | 2.117 | 1.917 | 1.917 | 1.817 | 1.817 | 1.650 | 1.650 | 1.650 | | |
| 15 | 1836 | 1,160.000 | 1,126.857 | 2.133 | 2.133 | 2.133 | 1.926 | 1.926 | 1.823 | 1.823 | 1.650 | 1.650 | 1.650 | | |
| 16 | 1822 | 1,195.000 | 1,160.857 | 2.148 | 2.148 | 2.148 | 1.935 | 1.935 | 1.828 | 1.828 | 1.650 | 1.650 | 1.650 | | |
| 17 | 1810 | 1,225.000 | 1,190.000 | 2.160 | 2.160 | 2.160 | 1.942 | 1.942 | 1.832 | 1.832 | 1.650 | 1.650 | 1.650 | | |
| 18 | 1794 | 1,265.000 | 1,228.857 | 2.177 | 2.177 | 2.177 | 1.951 | 1.951 | 1.838 | 1.838 | 1.650 | 1.650 | 1.650 | | |
| 19 | 1780 | 1,300.000 | 1,262.857 | 2.192 | 2.192 | 2.192 | 1.960 | 1.960 | 1.843 | 1.843 | 1.650 | 1.650 | 1.650 | | |
| 20 | 1768 | 1,330.000 | 1,292.000 | 2.204 | 2.204 | 2.204 | 1.967 | 1.967 | 1.848 | 1.848 | 1.650 | 1.650 | 1.650 | | |
| 21 | 1754 | 1,365.000 | 1,326.000 | 2.219 | 2.219 | 2.219 | 1.975 | 1.975 | 1.853 | 1.853 | 1.650 | 1.650 | 1.650 | | |
| 22 | 1744 | 1,390.000 | 1,350.286 | 2.229 | 2.229 | 2.229 | 1.981 | 1.981 | 1.857 | 1.857 | 1.650 | 1.650 | 1.650 | | |
| 23 | 1728 | 1,430.000 | 1,389.143 | 2.246 | 2.246 | 2.246 | 1.990 | 1.990 | 1.863 | 1.863 | 1.650 | 1.650 | 1.650 | | |
| 24 | 1714 | 1,465.000 | 1,423.143 | 2.260 | 2.260 | 2.260 | 1.999 | 1.999 | 1.868 | 1.868 | 1.650 | 1.650 | 1.650 | | |
| 25 | 1698 | 1,505.000 | 1,462.000 | 2.277 | 2.277 | 2.277 | 2.008 | 2.008 | 1.874 | 1.874 | 1.650 | 1.650 | 1.650 | | |
| 26 | 1688 | 1,530.000 | 1,486.286 | 2.288 | 2.288 | 2.288 | 2.014 | 2.014 | 1.878 | 1.878 | 1.650 | 1.650 | 1.650 | | |
| 27 | 1676 | 1,560.000 | 1,515.429 | 2.300 | 2.300 | 2.300 | 2.021 | 2.021 | 1.882 | 1.882 | 1.650 | 1.650 | 1.650 | | |
| 28 | 1658 | 1,605.000 | 1,559.143 | 2.319 | 2.319 | 2.319 | 2.032 | 2.032 | 1.889 | 1.889 | 1.650 | 1.650 | 1.650 | | |
| 29 | 1648 | 1,630.000 | 1,583.429 | 2.329 | 2.329 | 2.329 | 2.038 | 2.038 | 1.893 | 1.893 | 1.650 | 1.650 | 1.650 | | |

| | | | | | | | | | | | | | |
|---|---|---|---|---|---|---|---|---|---|---|---|---|---|
| 1 | 11 | 11 | 11 | 10 | 10 | 01 | 01 | 00 | | | p-1 | p-2 | p-3 |
| 2 | 11 | 11 | 11 | 10 | 10 | 01 | 01 | 00 | | | p-1 | p-2 | p-3 |
| 3 | 11 | 11 | 11 | 10 | 10 | 01 | 01 | 00 | | | p-1 | p-2 | p-3 |
| 4 | 11 | 11 | 11 | 10 | 10 | 01 | 01 | 00 | | | p-1 | p-2 | p-3 |
| : | : | : | : | : | : | : | : | : | | | : | : | : |
| : | : | : | : | : | : | : | : | : | | | : | : | : |
| : | : | : | : | : | : | : | : | : | | | : | : | : |
| : | : | : | : | : | : | : | : | : | | | : | : | : |
| 125 | 11 | 11 | 11 | 10 | 10 | 10 | 01 | 01 | 00 | 00 | p-1 | p-2 | p-3 |
| 126 | 11 | 11 | 11 | 10 | 10 | 10 | 01 | 01 | 00 | 00 | p-1 | p-2 | p-3 |
| 127 | 11 | 11 | 11 | 10 | 10 | 10 | 01 | 01 | 00 | 00 | p-1 | p-2 | p-3 |
| 128 | 11 | 11 | 11 | 10 | 10 | 10 | 01 | 01 | 00 | 00 | p-1 | p-2 | p-3 |

FIG.6

| APC Level(~13) | RESIDUAL INTERVAL(us) | SUSTAIN PERIOD INCREMENT(us) |
|---|---|---|
| 1 | 685 | 685/2026=0.338 |
| 2 | 715 | 715/2014=0.355 |
| 3 | 755 | 755/1995=0.378 |
| 4 | 790 | 790/1984=0.398 |
| 5 | 820 | 820/1972= |
| 6 | 855 | 855/1958= |
| 7 | 890 | 890/1944= |
| 8 | 920 | 920/1932= |
| 9 | 950 | 950/1920= |
| 10 | 990 | 990/1904= |
| 11 | 1020 | 1020/1892=0.539 |
| 12 | 1060 | 1060/1879=0.564 |
| 13 | 1095 | 1095/1862=0.588 |
| 14 | 1120 | 1120/1852=0.604 |

FIG.7

| APC Level(~13) | RESIDUAL INTERVAL(us) | RESET PERIOD INCREMENT(us) |
|---|---|---|
| 1 | 685 | 685/12=57 |
| 2 | 715 | 715/12=59 |
| 3 | 755 | 755/12=62 |
| 4 | 790 | 790/12=65 |
| 5 | 820 | 820/12= |
| 6 | 855 | 855/12= |
| 7 | 890 | 890/12= |
| 8 | 920 | 920/12= |
| 9 | 950 | 950/12= |
| 10 | 990 | 990/12= |
| 11 | 1020 | 1020/12=85 |
| 12 | 1060 | 1060/12=88 |
| 13 | 1095 | 1095/12=91 |
| 14 | 1120 | 1120/12=93 |

APPARATUS AND METHOD FOR DRIVING PLASMA DISPLAY PANEL USING ADAPTIVE WAVEFORM MECHANISM

This application claims the benefit of Korean Patent Application No. 2002-0032908, filed on Jun. 12, 2002, which is hereby incorporated by reference for all purposes as if fully set forth herein.

BACKGROUND OF THE INVENTION

1. Field of the Invention

The present invention relates to an apparatus and a method for driving a display panel. More specifically, the present invention relates to an apparatus and method for driving a plasma display panel (PDP), using an adaptive waveform mechanism that efficiently utilizes a pause period, which occurs in realizing automatic power control (APC) operation for controlling power consumption.

2. Discussion of the Related Art

A PDP is a display device that has a plurality of discharge cells in a matrix form. The PDP selectively activates the cells to emit light and reconstitutes input image data.

PDPs have at least one pair of a scan electrode and a sustain electrode. There are electrodes arranged opposing each other in parallel. The PDP has at least one address electrode disposed perpendicular to the scan electrode and the sustain electrodes. An addressing operation is performed by applying a scan pulse voltage to at least one of the scan electrode and the sustain electrode and an address voltage to the address electrode. As a result, a discharge between the scan electrode or the sustain electrode and the address electrode, changes electrical properties at the intersection of those electrodes to be addressed. A sustain operation applies a sustain pulse voltage between the scan electrode and the sustain electrode after the addressing operation, thereby causing a discharge where the electrical properties have changed.

The PDP should be capable of displaying various gray scales, for use as a color display device. It shows such gray scales by dividing a field into a plurality of sub-fields and controlling the sub-fields via time division control.

Among the PDP driving methods currently used, the address display separation (ADS) driving method starts sustain operation after completing the address operation for the entire PDP. Thus, the address operation and the sustain operation is totally separated. The ADS driving method is now adopted by most PDP manufacturers and employed by the present invention.

The PDP has a high power consumption due to its driving mechanism. The APC technique is used to control power consumption according to the load rate (i.e., average signal level or load ratio) of a frame to be displayed. The APC technique is an approach for controlling power consumption by varying the number of sustain pulses according to the load rate of image data.

When using the APC technique for driving the PDP, a pause period occurs in a field during which none of the reset, address, and sustain sequences are activated. The pause period refers to an interval during which no operation is activated in the reset, address, and sustain intervals.

FIG. 1 illustrates pause period distribution of APC levels in the related art. The triangle area (A) represents the pause period in driving the PDP when using the APC technique. According to the related art there is no special processing for the pause interval. The pause interval lasts longer when using a slow APC.

The address delays occurring in the address intervals among the PDP driving sequences may be changed to be longer or shorter according to the charge distribution before discharging the cells of the PDP. One technique is a Slow APC that changes the APC level at intervals of 0.5 seconds, thereby the brightness change of the display cannot be recognized at the APC levels sensed by the human retina and is mostly concentrated in the latter part of the sub-field array. An increased address delay makes the discharge of the discharge cells unstable and increases the possibility of an abnormal addressing operation, thereby making the reset, address, and sustain sequences non-uniform.

SUMMARY OF THE INVENTION

It is an advantage of the present invention to provide an apparatus and method for driving a PDP using an adaptive waveform mechanism for efficiently using a given time in one TV field to induce a stable discharge of all cells constituting a display, and uniformly dispersing a non luminescent region in one TV field to reduce a pseudo contour in driving the PDP using an APG technique.

BRIEF DESCRIPTION OF THE DRAWINGS

The accompanying drawings, which are incorporated in and constitute a part of the specification, illustrate embodiments of the invention, and, together with the description, serve to explain the principles of the invention.

FIG. 2 illustrates adaptive address pulse width of each sub-field in a PDP driving method using an adaptive waveform mechanism according to an embodiment of the present invention.

FIG. 6 illustrates the pulse width increments of each sustain pulse in a PDP driving method using an adaptive waveform according to another embodiment of the present invention.

FIG. 7 illustrates pulse width increments of each reset pulse in a PDP driving method using an adaptive waveform according to another embodiment of the present invention.

DETAILED DESCRIPTION OF THE ILLUSTRATED EMBODIMENTS

Figure 1:
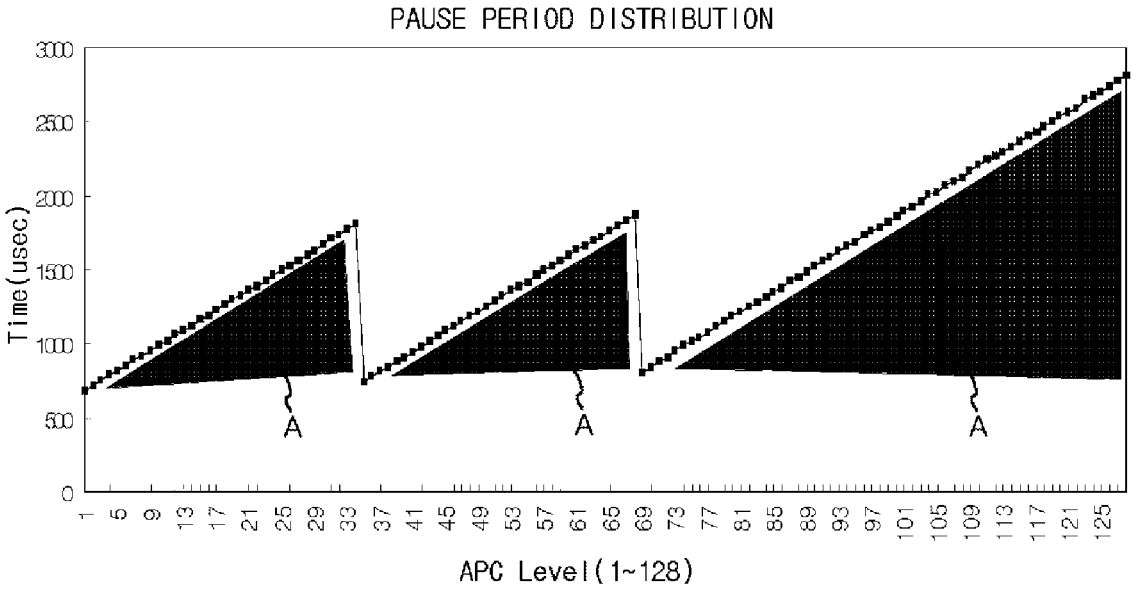
FIG.1 (Prior Art)
FIG. 1 illustrates the pause period distribution of APC levels according to the related art.

Reference will now be made in detail to embodiments of the present invention, examples of which are illustrated in the accompanying drawings. The invention is capable of modification in various obvious respects, all without departing from the invention. Accordingly, the drawings and description are to be regarded as illustrative in nature, and not restrictive.

In embodiments of present invention, the pause period occurring in driving a PDP according to the APC technique is used for expanding an address pulse width, a sustain, or a reset pulse width in order to induce a stable discharge of the cells, thereby reducing a pseudo contour. A pseudo contour is the pause period can also be used for expanding a combination of at least two of the sustain, reset, and address pulse widths.

A description for the expansion of the address pulse width of the pause period according to an embodiment of the present invention follows.

FIG. 2 illustrates adaptive address pulse width of each sub-field in a PDP driving method using an adaptive waveform according to an embodiment of the present invention. The pause period is used for expanding the address pulse width. The expansion of the address pulse width eventually leads to that of the whole address interval. The pause period occurs when driving a PDP with an APC technique. The address interval is equal to the summation of the address pulse widths for all lines. The adaptive address pulse width is the address pulse width expanded using the pause period. The adaptive address pulse mechanism provides a substantial expansion of the address pulse width by allocating the pause period to the address pulse width.

The address pulse width of all sub-fields can be expanded, but this method is very inefficient. Accordingly, the present invention expands the address pulse widths of the sub-fields on the least significant bit (LSB) side and maintains the address pulse widths of the sub-fields on the most significant bit (MSB) side.

Different methods can be used for realizing the expansion of the address pulse widths of the sub-fields on the LSB side. For example, one method expands each of the address pulse widths of the sub-fields on the LSB side. Another method divides all sub-fields into a predetermined number of sub-field groups and specifies the address pulse width to be expanded by the respective groups.

In any method used for expanding the address pulse widths of the sub-fields on the LSB side, the pause period in one TV field should be equal to or greater than the summation of the expanded lengths of the adaptive address pulse widths.

In an embodiment of the present invention, sub-fields are divided into several sub-field groups for the expansion of the address pulse widths. A defined formula may be used to differentiate the adaptive address pulse widths by the respective groups.

In the formula, the number of sub-fields included in one group is (N). The total number of sub-fields is (M), the number of scan lines is (SL), and the pause period is (R). The increment per reference width (AP) in the structure of the adaptive address pulse width can be calculated according to the following equation:

$$AP=(R/(SL*M))*(1\pm(N/M)) \quad \text{[Equation 1]}$$

In the equation, (1±(N/M)) represents a weight. An addition (+) is assigned to the sub-fields for a larger increment of the address pulse width and subtraction (−) is assigned to the sub-fields for a smaller increment of the address pulse width, for calculating each address pulse width.

Referring to FIG. 2, the sub-fields are divided into four sub-field groups. The sub-fields in each sub-field group have the same address pulse width. Referring to FIG. 2, there are ten sub-fields 1SF, 2SF, 3SF, 4SF, 5SF, 6SF, 7SF, 8SF, 9SF, and 10SF. The sub-fields 1SF, 2SF, and 3SF belong to the first sub-field group closest to the LSB side. Sub-fields 4SF and 5SF belong to the second sub-field group, sub-fields 6SF and 7SF belong to the third sub-field group, and sub-fields 8SF, 9SF, and 10SF belongs to the fourth sub-field group and nearest to the MSB side. As shown, the address pulse width of the sub-fields in the sub-field groups on the LSB side are expanded more than the other sub-field groups. The address pulse widths of the sub-fields on the MSB side is the same as before (i.e., the address pulse width is not expanded by the pause period). A variety of different methods may be used to expand the address pulse width. For example, the address pulse width may be expanded uniformly for the other three sub-field groups rather than the MSB sub-field group.

Referring to FIG. 2, there are ten sub fields 1SF, 2SF, 3SF, 4SF, 5SF, 6SF, 7SF, 8SF, 9SF, and 10SF. The sub-fields 1SF, 2SF, and 3SF belong to the first sub field group closest to the LSB side. Sub fields, 4SF and 5SF belong to the second sub field group, sub fields 6SF and 7SF belong to the third sub field group, and sub fields 8SF, 9SF, and 10SF belong to the fourth sub field group and nearest to the MSB side.

At an APC level of 1 the number of sustain pulses is 2026 and the residual time (i.e., the pause period is 685 μs). In this embodiment, most of the pause period is used for expanding the address pulse width. The address pulse width in the MSB sub-field group, sub-fields 8SF, 9SF, and 10SF is 1.650 μs, which is the same as before. The address pulse width of the sub-fields in the first sub-field group on the LSB side is 1.935 μs, which is increased by 0.285 μs. The address pulse width of the second sub-field group on the LSB side is 1.813 μs, which is increased by 0.163 μs. The address pulse width of the sub-field in the third sub-field group on the LSB side is 1.752 μs, which is increased by 0.102 μs.

The present invention applies an address pulse width that is increased by 1.385 μs. This is equal to the summation of (0.285×3+0.163×2+0.102×2 μs) to all of the lines in the PDP. Therefore, a PDP having a resolution of 480×852 will have an expanded address pulse width of 664.8 μs, that is equal to (1.385×480 μs). Referring to FIG. 2, the time of about 665.429 μs, out of the pause period, is used for expanding the address pulse width. In the other APC levels, the procedures are the same as for the APC level of 1, except the increments applied to the respective sub-field groups are changed as the number of sustain pulses is changed in those APL levels.

The adaptive address pulses allocated by the respective sub-fields are predetermined so that they can be calculated with the number of sustain pulses for the corresponding APC level, when the APC level is determined according to a load rate for frame data by the APC technique.

Figure 3:
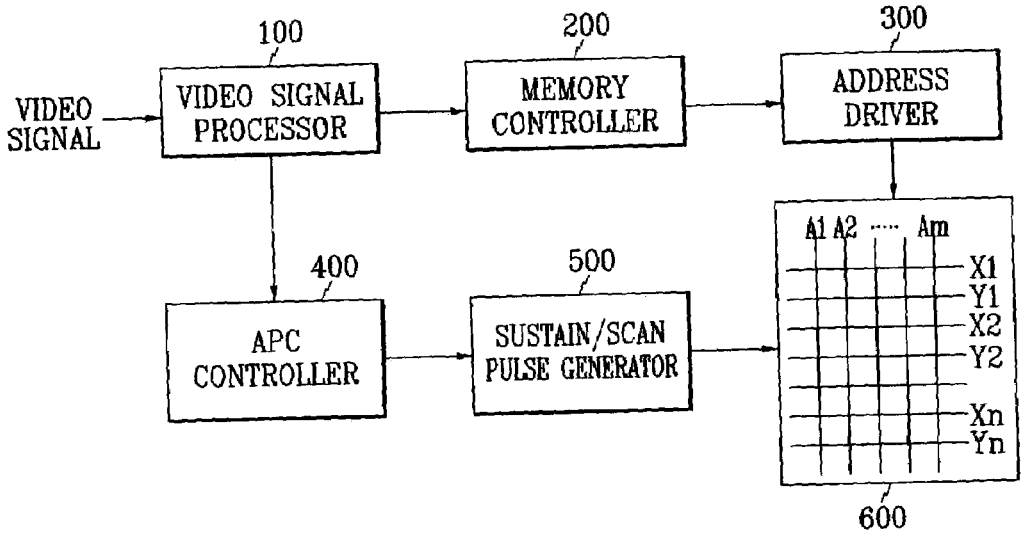
FIG. 3 illustrates a high level diagram of a PDP driving apparatus using an adaptive waveform according to an embodiment of the present invention.

FIG. 3 illustrates a high level diagram of a PDP driving apparatus using an adaptive waveform according to an embodiment of the present invention. The PDP driving apparatus includes a video signal processor 100, a memory controller 200, an address driver 300, an APC controller 400, and a sustain/scan pulse generator 500.

The video signal processor 100 performs basic signal processing, such as gamma correction, error propagation, and the like, for receiving video signals from outside, and outputs corresponding image data, for example, RGB image data. The memory controller 200 generates sub-field data corresponding to the RGB image data output from the video signal processor 100. The address driver 300 generates address data corresponding to the sub-field data output from the memory controller 200, and applies the generated address data to address electrodes $A_1$, $A_2$, . . . and $A_m$ of the plasma display panel 600.

The APC controller 400 detects a load rate using the output image data, for example RGB image data, from the video signal processor 100, determines an APC level according to the detected load rate and calculates the number of sustain pulses and the address pulse widths of the individual sub-fields corresponding to the APC level. The address pulse widths of the individual sub-fields are expanded. Thus, the total expanded time is shorter than the pause period for the APC level.

With all sub-fields divided into four groups, the sub-fields belonging to the LSB sub-field group have the greatest address pulse width. The sub-fields belonging to the MSB sub-field group have the same address pulse width as before.

The sustain/scan pulse generator 500 provides a sub-field array structure corresponding to the number of sustain pulses and the address pulse widths of the individual sub-fields received from the APC controller 400. The sustain/scan pulse generator 500 generates sustain and scan pulses based on the sub-field array and applies the generated sustain and scan pulses to scan electrodes $X_1$, $X_2$, . . . and $X_n$ and sustain electrodes $Y_1$, $Y_2$, . . . and $Y_n$ of the plasma display panel 600.

Figure 4:
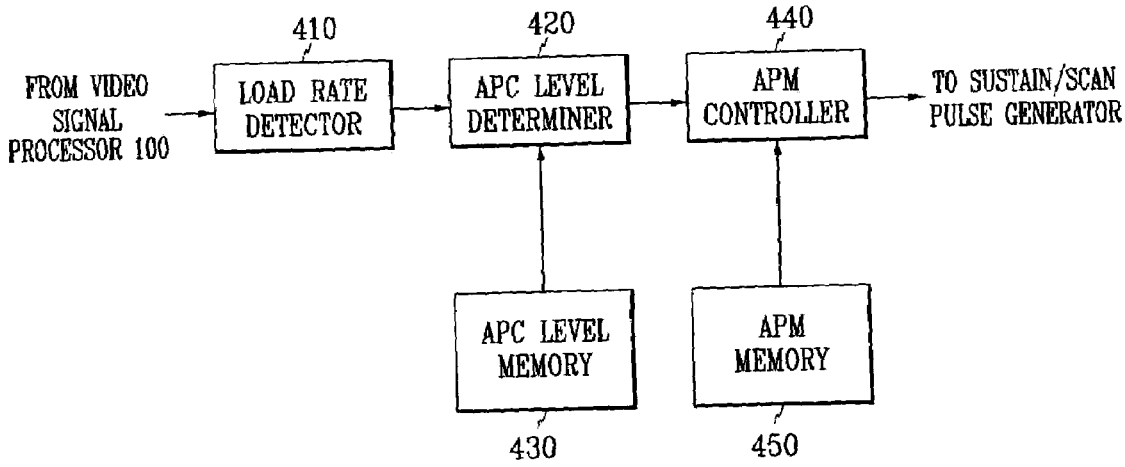
FIG. 4 illustrates a high level diagram of an APC controller of the PDP using the adaptive waveform as shown in FIG. 3.

FIG. 4 illustrates a high level diagram of an APC controller of the PDP using the adaptive waveform as shown in FIG. 3. The APC controller includes a load rate detector 410, an APC level determiner 420, an APC level memory 430, an adaptive address pulse mechanism (APM) controller 440, and an APM memory 450.

The load rate detector 410 detects a load rate from the image data, for example RGB data, output from the video signal processor 100. The detection of the load rate is performed by any available methods and will not be further described.

The APC level determiner 420 determines the necessary APC level for driving the plasma display panel 600. That is, for example, the number of sustain pulses, which may be based on the load rate output from the load rate detector 410. The APC level corresponding to the load rate is determined with reference to the APC level memory 430. The APC level memory 430 also stores information on the number of sustain pulses for the corresponding APC level, so that the APC level and the number of sustain pulses for the corresponding load rate can be determined. The APC level determiner 420 outputs the determined APC level and the determined number of sustain pulses to the sustain/scan pulse generator 500.

The APM controller 440 determines the address pulse width of each sub-field necessary for driving the plasma display panel based on the APC level output from the APC level determiner 420, so as to perform APM for allocating a part of the pause period occurring in using the APC technique according to the embodiment of the present invention in the expansion of the address pulse width of each sub-field. The address pulse width of each sub-field for the APC level is determined with reference to the APM memory 450. The APM controller 440 outputs the address pulse width of each sub-field corresponding to the APC level to the sustain/scan pulse generator 500.

The APM memory 450 may store the address pulse widths of all the sub-fields for each APC level as the corresponding time, in which case all the address pulse, widths must be stored in the APM memory 450, increasing a required memory capacity and thereby leading to an increase in the cost. In this embodiment, the APM memory 450 stores only the increment of the address pulse width of the corresponding sub-field. In this case, the sub-fields are divided into four sub-field groups, the sub-fields belonging to the same sub-field group have the same address pulse width, and the address pulse width of sub-fields belonging to the MSB sub-field group is the same as before. As a result, the APM memory 450 only has to store three address pulse widths, and the memory capacity is reduced relatively.

Figures 5A, 5B:
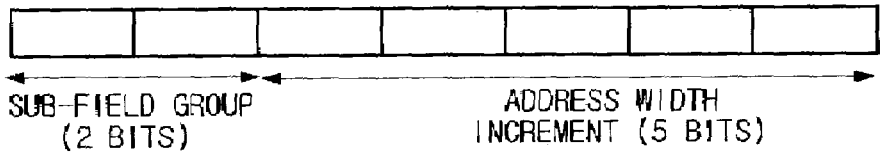
FIGS. 5A and 5B illustrate an exemplary structures of the APM memory of FIG. 4.

The structure of the APM memory 450 is illustrated in FIGS. 5A and 5B. There are four 7-bit data sets related to the address pulse widths for one APC level. The four data sets are concerned with four sub-field groups, respectively. The first two of the seven bits specify the sub-field group. The other five bits specify an address pulse group increment. The address pulse widths for the MSB sub-field that have no increment are set to zero.

The structure of the APM memory 450 can also be designed in a different way. For example, the data of the MSB sub-field grouping have the same address pulse width as before. Each increment data set of the other three sub-field groups may be added to the data of the MSB sub-field group in order to determine the address pulse width of each sub-field belonging to the three sub-field groups.

Referring to FIG. 5*b*, all sub-fields for the APC level are denoted by codes, for example, 11, 10, 01, and 00. These represent the respective sub-field groups and increment data of the address pulse widths for the respective sub-field groups.

The address pulse width can be determined by adding corresponding increment data to the data of the MSB sub-field group represented by code 00 for the sub-field groups having an increasing address pulse width.

The eight sub-fields are divided into four sub-field groups for the APC level of less than 125. The first sub-field group on the LSB side includes three sub-fields, the second sub-field group includes two sub-fields, and the third sub-field group includes two sub-fields, and the fourth sub-field group includes one sub-field.

For the APC level of 125 or the more, the ten sub-fields are divided into four sub-field groups according to a variable sub-field technique. Among these sub-field groups, the first sub-field group on the LSB side includes three sub-fields, the second sub-field group includes three sub-fields, the third sub-field group includes two sub-fields, and the fourth sub-field group includes two sub-fields.

A description will be given as to the allocation of the pause period in the expansion of the sustain pulse width in accordance with another embodiment of the present invention.

FIG. 6 illustrates the pulse width increments of each sustain pulse in a PDP driving method using an adaptive waveform according to another embodiment of the present invention. Referring to FIG. 6, the pause period occurring in driving a PDP via an APC technique is used for expanding the sustain pulse widths. Eventually, the expansion of the sustain pulse widths leads to that of the whole sustain interval. Here, the sustain interval is equal to the summation of the sustain pulse widths for all lines. The sustain pulse width expanded by the pause period corresponds to an adaptive sustain pulse width.

In the same manner as described in the previous embodiment, the sustain pulse width of the sub-fields on the MSB side may be the same as before and the sustain pulse width of the sub-fields on the LSB side are expanded. However, in this embodiment, a weighting value is set for each sub-field so as to determine a sustain pulse width. The weighting value is differentiated from the LSB sub-fields to the MSB sub-fields. The sustain pulse widths of the sub-fields on the LSB side are expanded more than those of the sub-fields on the MSB side.

As in the previous embodiment, in any method used for expanding the sustain pulse widths of the sub-fields on the LSB side, the pause period in one TV field may be equal to or greater than the summation of the increments of the adaptive sustain pulse widths.

A defined formula is used to differentiate the weighting value from the sustain pulse of the sub-fields on the LSB side to the sustain pulse of the sub-fields on the MSB side. Accordingly, the increment of the sustain pulse width by the weighting value can be calculated according to the following equation:

$$SUS(P)=(R/S(n))*(W(m)/M) \quad \text{[Equation 2]}$$

In the equation, (R) is the pause period and (S(n)) is the number of sustain pulses for the APC level of n,. (W(m)) is a weighting value of the m-th sub-field, and (M) is the total number of sub-fields and as W(m) increases as m gets smaller.

To set the sustain pulse width of the MSB sub-fields, as before without an increment, W(m) is set to zero when the m-th sub-field is the MSB sub-field. The total number of sub-fields are set to M when the m-th sub-field is the LSB sub-field to make the sustain pulse width of the LSB sub-fields have the maximum increment.

Referring to FIG. 6, at the APC level of 1 the number of sustain pulses is 2026 and the pause period is 685 μs. Accordingly, the maximum increment of the sustain pulse width of each sub-field is 0.338, which is equal to (685/2026 μs). For this maximum increment, the individual increments are determined according to the weighting value W(m) allocated to the respective sub-fields. For the other APC levels, the procedures are the same as described for the APC level of 1 and will not be further described.

In this manner, the adaptive sustain pulse allocated by the respective sub-fields is predetermined so as to be calculated with the number of sustain pulses for the corresponding APC level. The APC level is determined according to the load rate for frame data by the APC technique.

When a predetermined adaptive sustain pulse width is calculated instead of the adaptive address pulse width according to the APC level, the PDP driving apparatus allocates the pause period by increasing the sustain pulse width of each sub-field to drive a PDP. This is done in the first embodiment as previously described with reference to FIGS. 3, 4, and 5.

As described in detail, the pause period is used for expanding the sustain pulse width in order to stabilize a sustain pulse and induce a stable discharge of all cells, thereby the pseudo contour is reduced.

A description will be given as to the allocation of the pause period in expanding a reset pulse width according to another embodiment of the present invention.

FIG. 7 illustrates pulse width increments of each reset pulse in a PDP driving method using an adaptive waveform according to another embodiment of the present invention.

Referring to FIG. 7, the pause period in driving a PDP by the APC technique is allocated in expanding the reset pulse widths. Eventually, the expansion of the reset pulse widths leads to that of the whole reset interval. The reset interval is equal to the summation of the reset pulse widths for all lines. The reset pulse width expanded by the pause period corresponds to an adaptive reset pulse width.

In the same manner as in the previous embodiment, the weighting value, which is set for each sub-field so as to determine a reset pulse width, is differentiated from the sub-fields on the LSB side to the sub-fields on the MSB side. The reset pulse width of the sub-fields on the LSB side is expanded more than that of the sub-fields on the MSB side.

As in the previous embodiment, the pause period in one TV field may be equal to or greater than the summation of the increments of the adaptive reset pulse widths in any method used for expanding the reset pulse width of the sub-fields on the LSB side.

To differentiate the weighting value from the reset pulse of the sub-fields on the LSB side to those of the sub-fields on the MSB side a defined formula may be used as shown in the equation 3. The increment of the reset pulse width can be calculated according to the following equation:

$$RS(P)-(R/RP)*(W(m)/M) \quad \text{[Equation 3]}$$

(R) is the pause period, (RP) is the total number of reset pulses, (W(m)) is a weighting value of the m-th sub-field, and (M) is the total number of sub-fields. One reset pulse is generated per one sub-field, so (RP) is equal to the total number of sub-fields (M), and W(m) increases as m becomes smaller.

To set the reset pulse width of the MSB sub-fields as before without an increment, W(m) is set to zero when the m-th sub-field is the MSB sub-field. To make the reset pulse width of the LSB sub-fields have the maximum increment, the total number of sub-fields is set to M when the m-th sub-field is the LSB sub-field.

The set of wall charges in the reset interval is more important for the sub-fields on the LSB side. Preferably, the higher weighting value is allocated to the sub-fields on the LSB-side in this embodiment, as compared with the previous embodiment.

Referring to FIG. 7, for the APC level of 1 the pause period is 685 μs and the total number of sub-fields is 12. The maximum increment of the reset pulse width of each sub-field is 57 μs, which is equal to (685/12 μs). For this maximum increment, the individual increments are determined according to the weighting value W(m) allocated to the respective sub-fields. The procedures are the same as described for the APC level of 1 for the other APC levels and will not be further described.

When the APC level is determined according to the load rate for frame data by the APC technique, the adaptive reset pulse allocated by the respective sub-fields is predetermined so as to be calculated with the number of reset pulses for the corresponding APC level.

When a predetermined adaptive reset pulse width is calculated instead of an adaptive address pulse width according to the APC level determined by the load rate of frame data, the PDP driving apparatus using an adaptive waveform mechanism for allocating the pause period in increasing the address pulse width of each sub-field to drive a PDP in the first embodiment described with reference to FIGS. 3, 4, and 5 is the same as the PDP driving apparatus using an adaptive waveform mechanism for allocating the pause period in increasing the reset pulse width of each sub-field to drive a PDP, and will not be further described.

As described above, the pause period is used for expanding the reset pulse width to stabilize the reset operation for all cells and induce a stable discharge of all cells, thereby reducing a pseudo contour.

Although it has been described that the pause period is allocated in the expansion of the address pulse width, the sustain pulse width, or the reset pulse width, the present invention is not so limited. For example, the pause period may be allocated in the expansion of a pulse width determined by a combination of at least two of the three pulse widths.

Additionally, the pause period can be allocated to both the address pulse width and the sustain pulse width for expansion. The increments of the respective pulse widths in this case can be easily understood by those skilled in the art with reference to the description on the expansion of the respective pulse widths.

Figure 8:
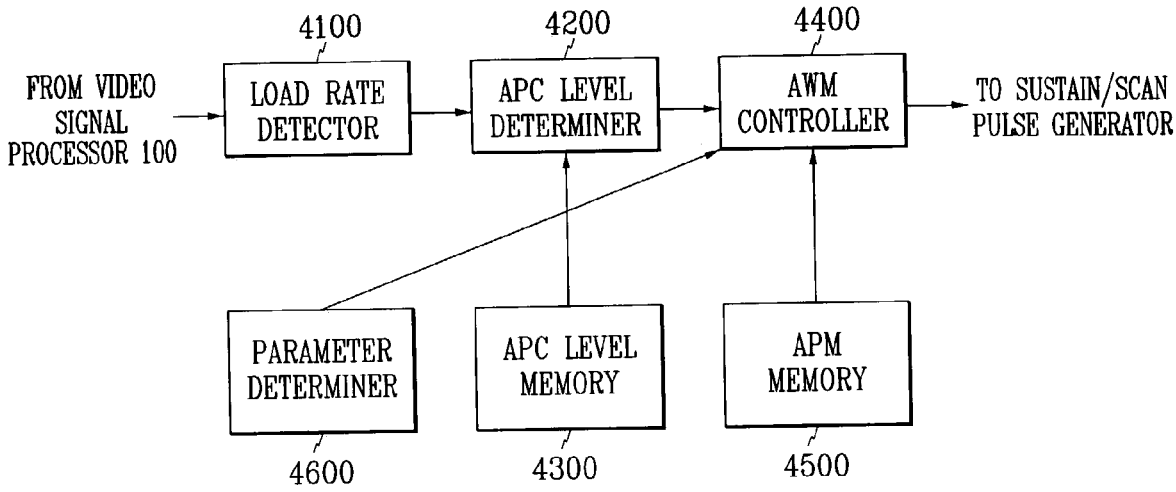
FIG. 8 illustrates a high level block diagram of an APC controller of a PDP using an adaptive waveform according to another embodiment of the present invention.

For expanding at least two of the address pulse width, the sustain pulse width, and the reset pulse width in combination, the structure of FIG. 4 as described above is used with minor modifications. For example, the user may select the pulse width control of the address pulse width, the sustain pulse width, or the reset pulse width and information on the weighting value so that the individual pulse widths are expanded according to the values selected by the user. FIG. 8 is a high level block diagram of an APC controller of a PDP using an adaptive waveform mechanism according to another embodiment of the present invention. FIG. 8 illustrates a load rate detector 4100, an APC level determiner 4200, an APC level memory 4300, an AWM controller 4400, an AWM memory 4500, and a parameter determiner 4600. The load rate detector 4100, the APC level determiner 4200, and the APC level memory 4300 have a similar function and operation as the load rate detector 410, the APC level determiner 420, and the APC level memory 430 as shown in FIG. 4, and will not be further described.

The AWM controller 4400 executes an adaptive waveform that allocates a part of the pause period occurring in using the APC technique to the expansion of the pulse width of each sub-field combined by the user among the address pulse, the sustain pulse, and the reset pulse.

Therefore, the AWM controller 4400 enables the expansion of each pulse width determined by a combination of at least two of the three pulse widths, as well as the expansion of the address pulse width, the sustain pulse width, or the reset pulse width using the pause period.

The address pulse width, the sustain pulse width, or the reset pulse width corresponding to each sub-field for the APC level is determined with reference to the AWM memory 4500.

By using the parameter determiner 4600, the user can determine whether to expand each pulse width by each of the address pulse, the sustain pulse, and the reset pulse, or a combination of at least two of the three pulses, and calculate a weighting value for the pulse width by the LSB to MSB sub-fields for expansion of the pulse width determined by each combination.

Accordingly, the AWM controller 4400 receives information on whether to expand the width of the address, sustain, or reset pulse, and the weighting value for the pulse width by the respective sub-fields from the parameter determiner 4600, expands the width of each pulse with reference to the AWM memory 4500, and outputs the result to the sustain/scan pulse generator 500.

While this invention has been described in connection with what is presently considered to be the most practical and preferred embodiment, it is to be understood that the invention is not limited to the disclosed embodiments, but on the contrary, is intended to cover various modifications and equivalent arrangements included within the spirit and scope of the appended claims.

As described above, the present invention efficiently utilizes the pause period occurring in driving a PDP by the APC technique to eliminate discharge defects, and uniformly disperses the non-luminous region in one TV field to reduce a pseudo contour.

What is claimed is:

1. A method for driving a plasma display panel, comprising:

determining an automatic power control (APC) level necessary for driving the plasma display panel;

determining an adaptive pulse width of an address pulse, a reset pulse, or a sustain pulse using the APC level, the determined adaptive pulse width including as an increment a part of a pause period occurring in driving the plasma display panal at the determined APC level; and driving the plasma display panel according to the adaptive pulse width for each sub-field as determined.

2. The method of claim 1, further comprising:

detecting a load rate of an input video signal prior to determining the APC level.

3. The method of claim 1, wherein the determining an adaptive pulse width, further comprises:

including the pause period as an increment of the address pulse width;

dividing all the sub-fields for the APC level into a predetermined number of sub-field groups; and allocating a same address pulse width to the sub-fields belonging to a same sub-field group.

4. The method of claim 3, wherein the number of the sub-field groups is 4.

5. The method of claim 1, wherein a different address pulse width is allocated to each sub-field group.

6. The method of claim 3, wherein the address pulse widths allocated to the sub-fields belonging to the sub-field groups on a least significant bit (LSB) side are greater than the address pulse widths allocated to the sub-fields belonging to the sub-field groups on a most significant bit (MSB) side.

7. The method of claim 6, wherein the address pulse width allocated to the sub-fields belonging to sub-field groups on the MSB side does not include a period increment related to the pause period.

8. The method for of claim 1, wherein the step of determining an adaptive pulse width comprises:

when a part of the pause period is included as an increment of the sustain pulse width, determining a weighting value for each sub-field so that the sustain pulse widths allocated to the sub-fields belonging to the sub-field groups on a LSB side are greater than the sustain pulse widths allocated to the sub-fields belonging to the sub-field groups on a MSB side.

9. The method of claim 8, wherein the sustain pulse width allocated to the sub-fields belonging to the MSB sub-field groups does not include a period increment related to the pause period.

10. The method of claim 1, wherein the step of determining an adaptive pulse width comprises:

when a part of the pause period is included as an increment of the reset pulse width, determining a weighting value for each sub-field so that the reset pulse widths allocated to the sub-fields belonging to the sub-field groups on a LSB side are greater than the reset pulse widths allocated to the sub-fields belonging to the sub-field groups on a MSB side.

11. The method of claim 10, wherein the reset pulse width allocated to the sub-fields belong to the MSB sub-field groups does not include a period increment related to the pause period.

12. An apparatus for driving a plasma display panel, in which an image of each field displayed on the plasma display panel in correspondence to an input video signal is divided into a plurality of sub-fields each having a different weight, and a combination of the weights of the sub-fields is used for representing gradation, the apparatus comprising:

a memory controller for generating sub-field data corresponding to the input video signal;

an address driver for generating address data corresponding to the sub-field data output from the memory controller, and applying the generated address data to the plasma display panel;

an APC controller for determining an APC level necessary for driving the plasma display panel using the input video signal, and calculating a pulse width comprising any one of an address pulse width, a sustain pulse width and a reset pulse width for each sub-field, or a combination of at least two of the three pulse widths according to the determined APC level, the determined adaptive pulse width including as an increment a part of a pause period occurring in driving the plasma display panel at the APC level; and a sustain/scan pulse generator for providing a sub-field array structure corresponding to the input video signal and the determined sub-field-based pulse width from the APC controller, generating control signals based on the sub-field array, and applying the generated control signals to the plasma display panel.

13. The apparatus of claim 12, wherein the APC controller comprises:

a load rate detector for detecting a load rate from the input video signal;

an APC level determiner for determining the APC level based on the load rate output from the load rate detector; and a pulse width controller for determining the pulse width for each sub-field based on the determined APC level from the APC level determiner.

14. The apparatus of claim 13, further comprising:

a memory having an APC level corresponding to the load rate; and a memory having an address pulse width, a sustain pulse width, and a reset pulse width for each sub-field corresponding to the APC level.

15. The apparatus of claim 13, further comprising:

a parameter determiner for determining a specific combination of at least two of the address pulse width, the sustain pulse width, and the reset pulse width, and a weighting value for each sub-field corresponding to the determined specific combination, and outputting the determined specific combination and the weight to the pulse width controller, when a part of the pause period is included as an increment of the pulse width comprising any one of the address pulse width, the sustain pulse width, and the reset pulse width, or a combination of at least two of the pulse widths.

16. A method for driving a plasma display panel, in which an image of each field displayed on the plasma display panel in correspondence to an input video signal is divided into a plurality of sub-fields including an address interval, a sustain interval, and a reset interval, each sub-field having a different weight, and a combination of the weights of the sub-fields is used for representing gradation, the method comprising:

calculating a pause period occurring in driving the plasma display panel using an APC mode, by APC levels, the APC mode varying the number of sustain pulses applied to the plasma display panel according to a load rate of the input video signal;

allocating a part of the pause period calculated by the APC levels as an increment for expanding an interval comprising any one of the address interval, the sustain interval, and the reset interval, or a combination of at least two of the intervals; and driving the plasma display panel according to the expanded interval by the APC levels.

17. The method of claim 16, wherein the address interval corresponds to the summation of address pulse widths allocated by lines of the plasma display panel and the sub-fields, the expansion of the address interval being realized by expanding the address pulse widths.

18. The method of claim 16, wherein the sustain interval corresponds to the summation of a predetermined number of sustain pulse widths by the APC levels, the expansion of the sustain interval being realized by expanding the sustain pulse widths.

19. The method of claim 16, wherein the reset interval corresponds to the summation of reset pulse widths of as many as there are sub-fields, the expansion of the reset interval being realized by expanding the reset pulse widths.

* * * * *